US006024607A

United States Patent [19]

Wahl

[11] Patent Number: 6,024,607

[45] Date of Patent: Feb. 15, 2000

[54] FEMALE COMBINATION CONNECTOR

[75] Inventor: Mark A Wahl, Fort Collins, Colo.

[73] Assignee: Hewlett-Packard Company, Palo Alto, Calif.

[21] Appl. No.: 09/096,874

[22] Filed: Jun. 12, 1998

[51] Int. Cl.[7] ..... H01R 25/00

[52] U.S. Cl. ..... 439/639

[58] Field of Search ..... 439/639, 79

[56] References Cited

U.S. PATENT DOCUMENTS

| | | | |
|---|---|---|---|
| 5,030,128 | 7/1991 | Herron et al. | 439/639 |
| 5,411,416 | 5/1995 | Balon et al. | 439/639 |
| 5,807,140 | 9/1998 | Hopkins | 439/639 |
| 5,848,903 | 12/1998 | Gammenthaler | 439/79 |

FOREIGN PATENT DOCUMENTS

| | | | |
|---|---|---|---|
| 0 320 107 A2 | 6/1989 | European Pat. Off. | G06F 11/10 |

OTHER PUBLICATIONS

Ranoda Catalog—see Hybrid Combo Connector (this connector was available as of Sep. 26, 1995).

*Primary Examiner*—Michael L. Gellner
*Assistant Examiner*—Antoine Ngandjui

[57] ABSTRACT

A female combination connector for connecting a computer storage drive to a printed circuit board includes a plurality of female connector elements affixed to a base. The plurality of female connector elements correspond to a plurality of male connectors on the computer storage drive. The female combination connector also includes a printed circuit board connector. The printed circuit board connector includes a plurality of conductors, each of which is supported by the base, and each of which is electrically coupled to one of the plurality of female connector elements. The female connector elements may be elements such as a data connector (e.g., an IDE or SCSI data connector), a power connector, a digital audio connector, an analog audio connector, or a select connector (e.g., an IDE master/slave cable select connector or a SCSI identification select connector).

19 Claims, 4 Drawing Sheets

FEMALE COMBINATION CONNECTOR

FIELD OF THE INVENTION

The present invention relates generally to the field of connectors, and more particularly, to a system and method for connecting the multiple male connectors on a disk drive or other computer storage drive to a printed circuit board (pcb) using a female combination connector.

BACKGROUND

Computer storage drives (e.g., disk drives, tape drives, CD-ROMs, or DVDs) may be configured for internal or external use. Drives configured for internal use are referred to as internal drives, and drives configured for external use are referred to as external drives. Internal drives are typically mounted inside of a computer housing, or inside of a separate housing for multiple drives (such as a cd-rom jukebox for network data storage and retrieval). Internal drives usually serve as a component of a much larger system, and are not readily portable. On the other hand, external drives are typically mounted individually, inside of an external drive housing, and are readily portable. External drives are also advantageous in that they may be easily connected to any computer, and their use is not dedicated to a single computer.

Computer storage drives are generally provided with internal-type connectors. Internal-type connectors are suitable for use inside of a computer or other protective housing, and are not intended for frequent handling, connection, or movement. Internal-type connectors often lack sophisticated (or any) alignment means, and can therefore be incorrectly mated with a corresponding connector of the opposite sex.

Computer storage drives may be configured as internal drives with relative ease. Typically, a drive need only be mounted within a protective housing (e.g., a computer housing and/or a modular drive bay within the computer housing). Once mounted within a protective housing, internal-type cables may be connected to the drive's power and data connectors. Internal-type cables may comprise cables such as ribbon cables. These cables are not meant for frequent handling and flexing, and are not as rugged as external-type cables.

A computer storage drive may be configured as an external drive by placing it in an external housing, and connecting it to connectors, cables, and a printed circuit board which convert its internal-type connectors to external-type connectors. More rugged and standardized external-type cables may then be used to connect the external drive to a computer.

External drives are generally connected to a computer with a minimum number of cables to simplify use, whereas internal drives are generally provided with a greater number of cables organized by function. For example, external drives are often be connected to a computer using a single data cable with standard external connectors such as DB25 connectors (which are commonly used on printer cables). External connectors may be rugged and easy to align to facilitate connections by inexperienced and/or careless users, and may include screws or other means for keeping the connectors from inadvertently pulling apart. Power is usually supplied to an external drive through a separate cable having lower gauge (thicker) wires that are capable of carrying more electrical current than is required for the data signals carried by the data cable. Power and data cables are usually not combined in one cable unless the power requirements for a drive are very low, in order to avoid electrical interference between the power and data signals, and to save cost by using the thinnest wires necessary for the application.

Computer storage drives commonly have multiple connectors, and a cable is mated with each of the connectors, including one cable each for power, data, analog audio, digital audio, and miscellaneous controls. These connectors are internal-type connectors which are often simpler and cheaper than external-type connectors. They may be more difficult to align than external-type connectors, usually being rectangular and symmetrical. Some internal-type connectors have a notch on one side which slides over a ridge in a corresponding connector to ensure proper orientation, while others rely on visual indicators such as color-coded cables which do not physically prevent improper connections. In contrast, external-type connectors often have distinctive shapes to quickly identify the proper orientation and physically prevent any improper connections. Most internal-type connectors do not include a means to prevent the connectors from being inadvertently pulled apart, although some include self-locking plastic clips molded into the connector which must be compressed to disconnect.

The cables used internally and externally also differ. External-type cables may comprise a round bundle of individual wires, each with their own insulation, held together by an external insulation. Internal-type cables, commonly connected to computer storage drives, may comprise several individual wires, each with its own insulation and unconnected to other wires, or ribbon cables, in which the individual insulated wires lay side by side in a flat ribbon, with the ribbon growing wider as the number of wires is increased. Internal-type cables may be less expensive than external-type cables, but are generally not as compact, easy to use, or as visually appealing as external-type connectors.

To connect a computer storage drive inside a computer, several cables must be connected. The flat ribbon cables used for data must be routed through the often constricted, twisting spaces inside the computer, and their rectangular connectors must be properly oriented. This task is often complicated by cables which are provided with little spare length. The power and other cables mentioned above must also be connected, contributing to a confusing jumble of cables which require excessive labor to connect.

Consequently, a need exists for a system and method for connecting a computer storage drive to either a printed circuit board or plurality of cables, wherein the computer storage drive may be connected to the printed circuit board or plurality of cables in a single operation, without a need to connect numerous individual cables to the drive.

SUMMARY

To fill the above need, as well as other needs, the inventor has devised a female combination connector to assist in connecting a computer storage drive to either a printed circuit board or plurality of cables in a single connection operation.

In general, the female combination connector may comprise a plurality of female connectors corresponding to a plurality of male connectors on a computer storage drive. The plurality of female connectors are affixed to a common base. The female combination connector also comprises a printed circuit board connector. The printed circuit board connector comprises a plurality of conductors, each of which is supported by the base, and each of which is electrically coupled to one of the female connectors.

Alternatively, the female combination connector may comprise a base; a first means which is affixed to the base so as to provide a means for connecting the female combination connector to a plurality of male connectors of a computer storage drive; and second and third means, both of which are supported by the base so as to respectively provide 1) a means for connecting the female combination connector to a printed circuit board (thereby forming an electrical connection between the printed circuit board and the first means), and 2) a means for connecting the female combination connector to a power supply (thereby forming an electrical connection between the power supply and the first means).

A method of connecting a computer storage drive to a printed circuit board may comprise the steps of first mounting one of the afore-mentioned female combination connectors to a printed circuit board by electrically coupling the plurality of conductors of its printed circuit board connector to the printed circuit board, and then, in a single connection operation, connecting the male connectors of a computer storage drive to the female connector elements of the female combination connector.

These and other important advantages and objectives of a female combination connector, and method of using same, will be further explained in, or will become apparent from, the accompanying description, drawings and claims.

BRIEF DESCRIPTION OF THE DRAWINGS

Illustrative and presently preferred embodiments of the invention are illustrated in the drawings, in which.

DESCRIPTION OF THE PREFERRED EMBODIMENT

A female combination connector 10 (FIG. 1) may be used to connect a computer storage drive 12 to a printed circuit board (pcb) 14, thereby dispensing with any need for connecting multiple individual female connectors and/or cables to the computer storage drive 12.

Figure 1:
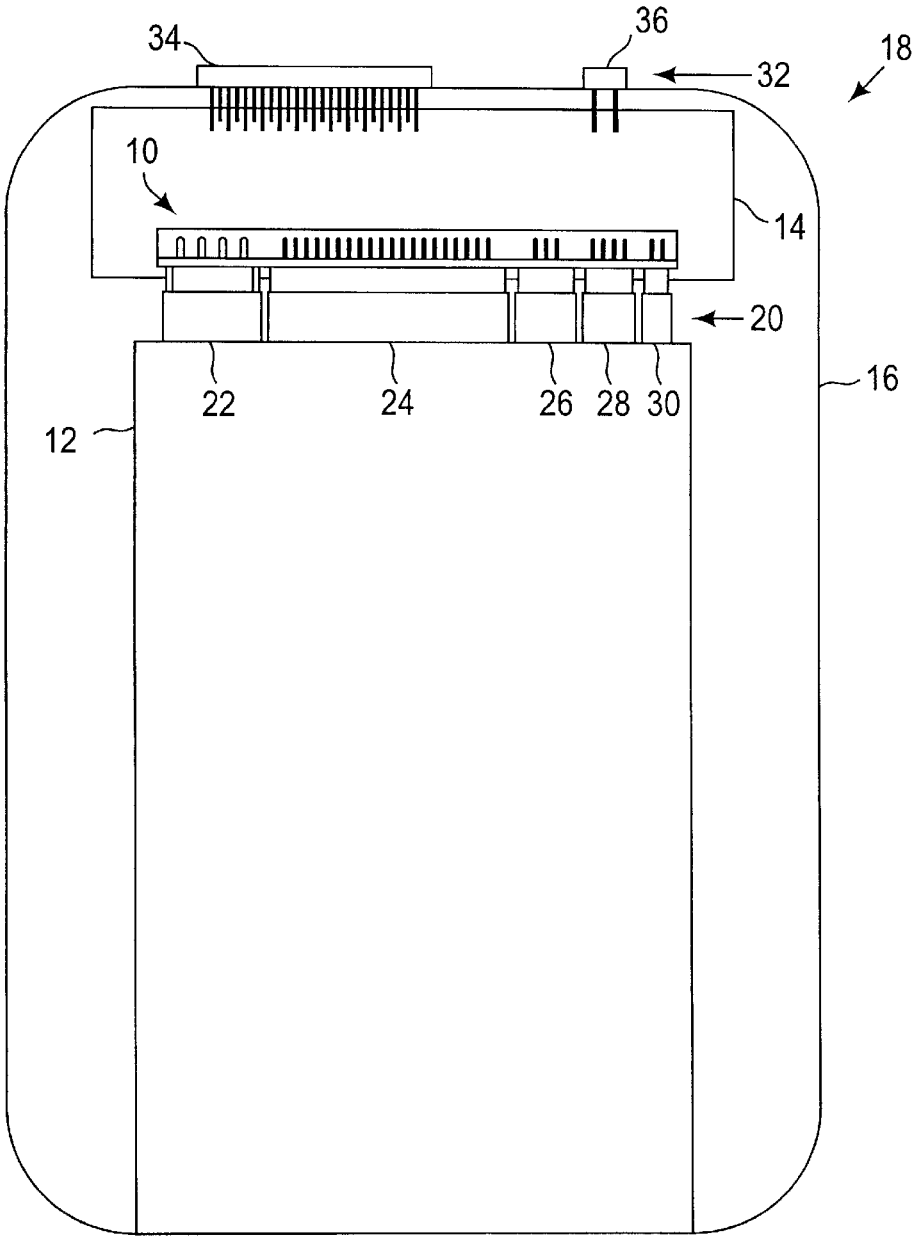
FIG. 1 is a top plan view of various components mounted in an external drive housing, the components comprising a five element IDE female combination connector.

For example, in the external drive 18 arrangement of FIG. 1, a female combination connector 10 is mounted on a pcb 14, and the male connector elements 20 of a computer storage drive 12 are mated to the female connector elements 54 (FIG. 3) of the female combination connector 10. The computer storage drive 12, female combination connector 10, and pcb 14 are all mounted interior to an external drive housing 16. Additional connector elements 32 are mounted to both the pcb 14 and the external drive housing 16 so as to be externally accessible on the external drive 18. These additional connector elements 32 provide connection points for conventional external-type cabling (e.g., conventional serial, parallel and/or SCSI data cables, as well as a conventional external power cable). The pcb may make conversions between the I/O signal types of the computer storage drive 12, and the I/O signal types of the externally accessible connector elements 32.

An external drive 18 such as the one pictured in FIG. 1 is advantageous over internal drives in that it is readily portable, and is not dedicated to use with only a single computer.

The computer storage drive 12 illustrated in FIG. 1 will typically comprise a plurality of internal-type male connectors 20, such as a power connector 22, a data connector 24, a select connector 26, an analog audio connector 28 and a digital audio connector 30. The select connector 26 may comprise an IDE master/slave cable select connector in an IDE configuration, or a SCSI identification select connector in a SCSI configuration, as will be discussed later. Internal-type connectors 20 are generally inexpensive connectors with limited alignment guides and locking mechanisms.

On the other hand, the externally accessible connector elements 32 of FIG. 1 will typically comprise external-type connectors such as a data connector 34 and a power connector 36. External-type connectors 32 are generally more expensive and durable than internal-type connectors 20, may include more elaborate alignment guides such as irregular shapes to prevent misalignment, and may include locking mechanisms such as screws to prevent inadvertent disconnection. External-type connectors 32 may comprise any of a number of connectors designed for external use. For example, in one embodiment, data connector 34 may comprise a DB25 connector. Due to increased cost, size, and labor requirements, computer storage drives are generally not fitted with external-type connectors (since most computer storage drives are configured for internal use and their connectors are infrequently accessed). As a result, the internal-type connectors 20 of a computer storage drive 12 will typically be converted to external-type connectors 32 if and when the computer storage drive 12 is to be used as an external drive 18. A further benefit of conversion from internal-type connectors 20 to external-type connectors 32 is the ability to use compact external cables outside of the external housing 16 (rather than bulky internal ribbon cables).

The pcb 14 of FIG. 1 may comprise a substrate and circuitry which connect the internal-type connectors 20 of the computer storage drive 12 to the external-type connectors 32 on the external housing 16. The circuitry on the pcb 14 may also perform other configuration and/or conversion functions for the computer storage drive 12. However, since the details of the circuitry associated with pcb 14 are not pertinent to an understanding of female combination connector 10, the particular pcb 14 and associated circuitry that may be utilized with one preferred embodiment use of the female combination connector 10 will not be described in further detail herein.

The female combination connector 10 may be used to connect the plurality of male connectors 20 of the computer storage drive 12 directly to the pcb 14 with one connection operation, and without the use of cables. The female combination connector 10 may further simplify the installation of the computer storage drive 12 inside the external drive housing 16 by allowing the computer storage drive 12 to be slid into the external drive housing 16 toward the female combination connector 10 until the male connectors 20 of the computer storage drive 12 engage and connect with the female connector elements 54 of the female combination connector 10. The two operations of mounting the computer storage drive 12 inside the external drive housing 16 and connecting the male connectors 20 of the computer storage drive 12 to the pcb 14 may thereby be combined, and a separate operation of connecting cables in the tight confines of the external drive housing 16 is avoided.

Figure 15:
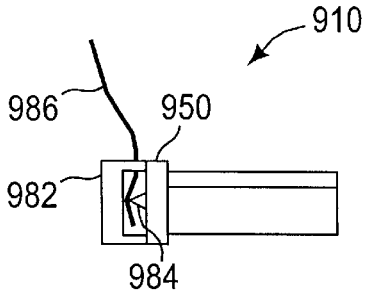
FIG. 15 is a side elevational view of a five element IDE female combination connector having means to connect it to a plurality of cables.

In a second application, the computer storage drive 12 may be mounted in a computer housing and connected directly to a pcb, or connected to a pcb indirectly via a plurality of cables. The same female combination connector 10 shown in FIG. 1 may be used to connect the computer storage drive 12 directly to a pcb in the computer with one connection operation. Alternatively, if the pcb is not located adjacent the male connectors 20 of the computer storage drive 12, a female combination connector may be configured to connect to one or more cables, allowing connection of multiple internal cables to a computer storage drive 12 with only one connection operation. In this manner, ribbon cables, a power cable, and the like may be connected to the female combination connector, and the female combination connector may be connected to a computer storage drive 12 with greater ease than if the cables were to be connected directly to the computer storage drive 12. Note that the female combination connector may then be connected to the computer storage drive 12 in a single operation. The connections between a computer storage drive 12 and a pcb via ribbon cables will be discussed in greater detail during a discussion of FIGS. 15 and 16 (later in this description).

A significant advantage of the female combination connector 10 is that it dramatically reduces the number of connection operations required to install a computer storage drive 12 in an external drive housing 16 (or any other housing). The need for bulky ribbon cables or other types of internal-type cables may be eliminated, thereby reducing or eliminating the likelihood of inadvertent disconnections due to tensions on cables and the likelihood of failures in the cables themselves. The female combination connector 10 is also more likely to stay seated and connected with the male connectors 20 of a computer storage drive 12 due to the increased friction provided by the larger number of pins and the individual housings combined in the female combination connector 10. Alignment difficulties inherent with all connectors, and particularly with internal-type connectors, are reduced as the various connector elements (e.g., 40, 42, and 44) of the female combination connector 10 provide a distinctive layout which is simpler to align than a single connector. A further advantage provided by the female combination connector 10 is in ease of disconnection. Each male connector 20 must otherwise be disconnected individually and may include a clip or other means to prevent inadvertent disconnection which must be compressed or otherwise unlocked before disconnecting the connector. The female combination connector 10 allows all male connectors 20 to be disconnected in one operation, with perhaps only one unlocking operation if a locking clip is provided for the combination connector 10.

Figure 2:
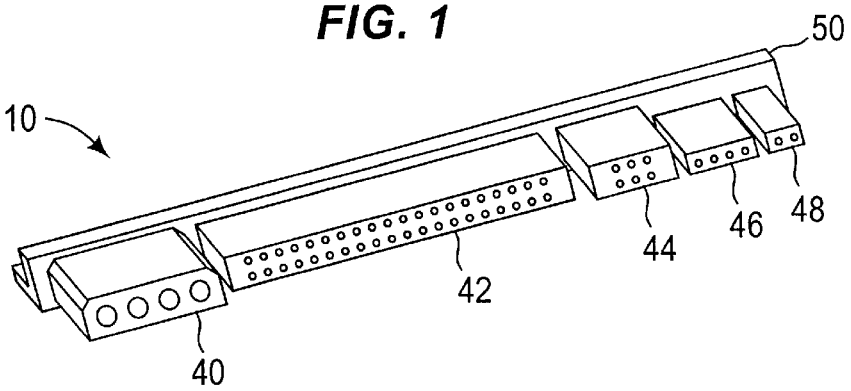
FIG. 2 is a perspective view of the five element IDE female combination connector shown in FIG. 1.
Figure 3:
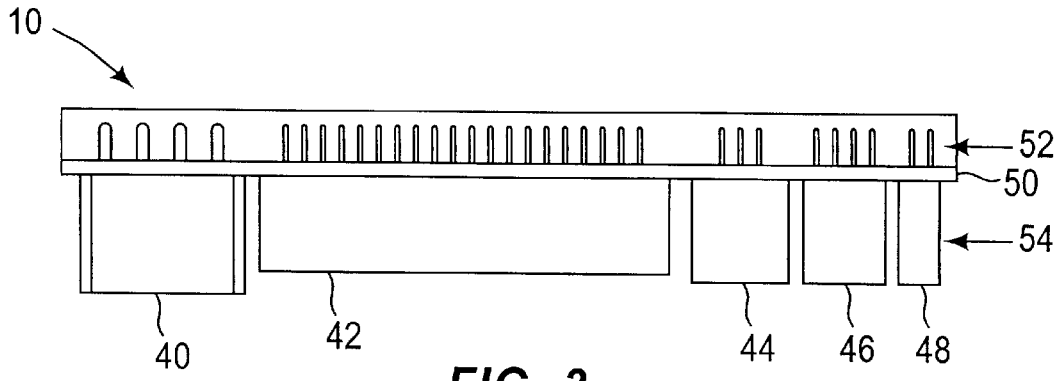
FIG. 3 is a top plan view of the FIG. 2 five element IDE female combination connector.
Figure 4:
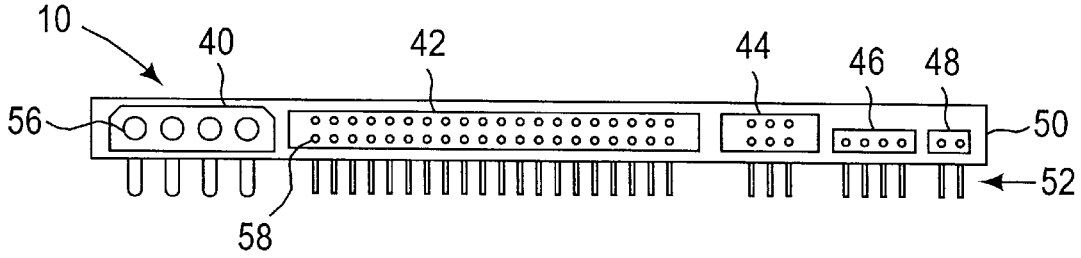
FIG. 4 is a front elevational view of the FIG. 2 five element IDE female combination connector.
Figure 10:
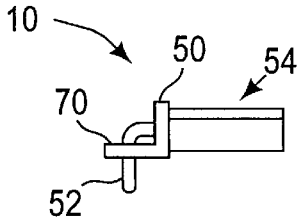
FIG. 10 is a side elevational view of the FIG. 2 five element IDE female combination connector.

In a preferred embodiment of a female combination connector 10, as illustrated in FIGS. 2–4, an IDE female combination connector comprises a base 50, five connector elements 54 (FIGS. 3, 4) (i.e., 40, 42, 44, 46, and 48) affixed to the base 50, and right-angle through-hole pins 52 for connection to a pcb (e.g., 14). (The right angle aspect of the pins 52 is best seen in FIG. 10.) In this embodiment, a female combination connector 10 is provided with five connector elements 54 for mating with the male connectors 20 of an IDE disk drive 12. A power connector 40 may comprise four sockets (e.g., 56, FIG. 4), typically sized for larger gauge pins than the smaller sockets (e.g., 58) on the data connector elements 42, 44, 46, and 48. A data connector 42 for an IDE disk drive typically includes 40 sockets (e.g., 58). Other IDE data connectors 44, 46, 48 may comprise a 6-socket master/slave cable select connector 44, a 4-socket analog audio connector 46, and a 2-socket digital audio connector 48. The connector elements 54 may be affixed to the base 50 in a predetermined spaced-apart relation based upon the placement of the corresponding male connectors 20 on the disk drive 12. The connector elements 54 may be affixed to the base 50 in a number of ways. For example, the connector elements 54 and the base 50 may be integrally molded as one unit, or may be individually manufactured and then bonded together using any method now known or that may be developed in the future. For example, individual elements 54 may be bonded with an adhesive, fused, or welded to the base 50. The connector elements 54 may be made from any of a wide range of materials suitable for electrical connectors, such as an insulating high temperature thermoplastic. Electrical contacts are housed within or near various sockets (e.g., 56 and 58) of the connectors 54, and may be configured in any suitable manner and made from any of a wide range of materials suitable for electrical applications. The electrical contacts (e.g., 56 and 58) of the connectors 54 connect with (or may be integral with) the right-angle through-hole pins 52 so as to provide an electrical connection between the connector elements 54 and a pcb (e.g., 14). Sockets housing electrical contacts are understood to be inherent elements of the female connectors and/or connector elements recited in the claims.

Other possible embodiments of a female combination connector include various combinations of connector elements 54 affixed to the base 50 as needed to mate with the male connectors (e.g., 20) of a computer storage drive (e.g., 12).

Figure 5:
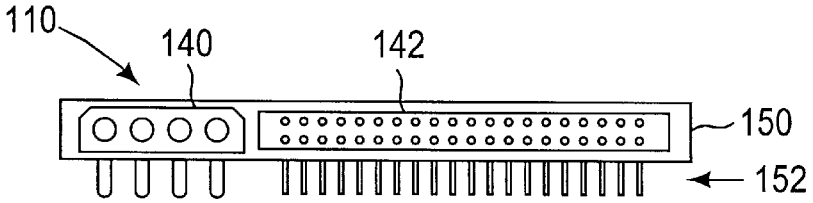
FIG. 5 is a front elevational view of a two element IDE female combination connector.

For example, in one embodiment a two-element IDE female combination connector 110 (FIG. 5) may comprise a power connector 140, a 40-socket IDE data connector 142, a base 150, and a pcb connector comprising a plurality of conductors such as right-angle through-hole pins 152.

Figure 6:
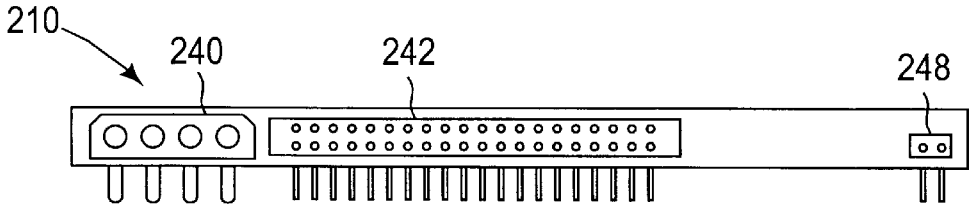
FIG. 6 is a front elevational view of a three element IDE female combination connector.

In another embodiment, a three-element IDE combination connector 210 (FIG. 6) may comprise a power connector 240, an IDE data connector 242, and a digital audio connector 248.

Figure 7:
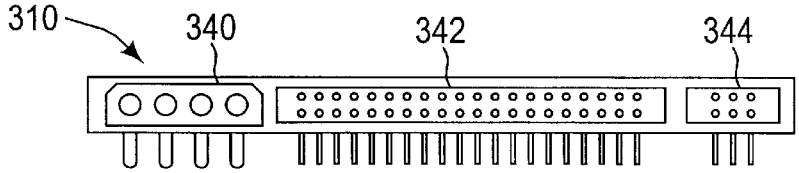
FIG. 7 is a front elevational view of an alternative three element IDE female combination connector.

In another embodiment, a three-element IDE combination connector 310 (FIG. 7) may comprise a power connector 340, an IDE data connector 342, and an IDE master/slave cable select connector 344.

Figure 8:
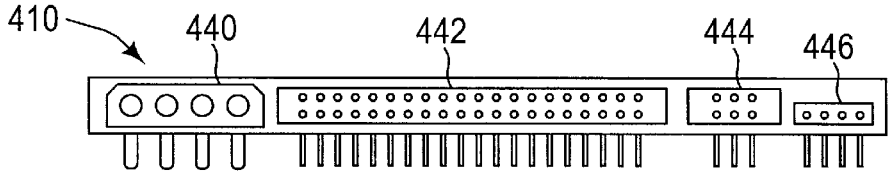
FIG. 8 is a front elevational view of a four element IDE female combination connector.

In yet another embodiment, a four-element IDE combination connector 410 (FIG. 8) may comprise a power connector 440, an IDE data connector 442, an IDE master/slave cable select connector 444, and an analog audio connector 446.

Figure 9:
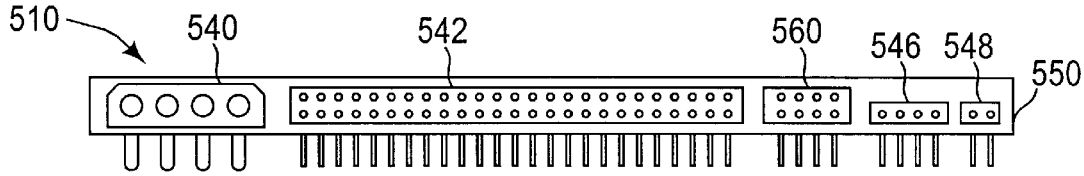
FIG. 9 is a front elevational view of a five element SCSI female combination connector.

A female combination connector may also be configured for use with a SCSI storage drive. As illustrated in FIG. 9, a five-element SCSI combination connector 510 may comprise a power connector 540, a 50-socket SCSI data connector 542, an 8-socket SCSI identification select connector 560, an analog audio connector 546, and a digital audio connector 548, all of which are affixed to a base 550. A female SCSI combination connector may also have various embodiments comprising different combinations of connector elements, as discussed above with respect to an IDE combination connector. The specific configuration of the connector elements discussed above with respect to IDE and SCSI combination connectors may also vary based on the application. For example, a SCSI identification select connector (e.g., 560) may comprise 6 sockets, 8 sockets, or 10 sockets in various configurations.

Exemplary configurations of a female combination connector designed for use with IDE and SCSI storage drives have been discussed herein. However a female combination connector 10 may be used to connect any computer storage drive having multiple male connectors to a pcb or plurality of cables. Accordingly, the female combination connectors discussed herein should not be regarded as limited to use with any particular computer storage device, data signal configuration, or type of pcb. Exemplary computer storage drives whose installations may benefit from the use of a female combination connector may include drives such as CD-ROMs, tape drives, ZIP® drives, floppy drives, hard drives, etc. Other devices which may be mounted in a drive bay of a computer may also benefit from the use of a female combination connector, such as a photograph scanner.

Various means for mounting a female combination connector (e.g., 10 and 110) to a pcb may be provided. In the preferred embodiment shown in FIG. 10, pcb connection pins 52 are provided. More specifically, right-angle through-hole pins 52 supported by base 50 are provided. First ends of the pins 52 are connected to contacts of the female connector elements 54. Second ends of the pins 52 may be inserted into corresponding holes in a pcb (e.g., 14), and may be soldered to electrical traces adjacent the holes. The right-angle aspect of the pins 52 allows the connector elements 54 to be oriented along the same plane as the pcb 14. A support member 70 may be included to provide additional support and alignment for the pins 52, as well as a mounting surface for the pcb 14.

Figure 11:
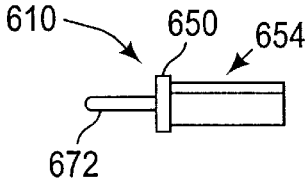
FIG. 11 is a side elevational view of a female combination connector having straight through-hole pins for connecting it to a printed circuit board.

Alternatively, a female combination connector 610 (FIG. 11) may include straight through-hole pins 672 supported by a base 650 which also serves as a mounting surface for the pcb 14. The through-hole pins 672 may be soldered to the pcb 14 as discussed above with respect to the right-angle through-hole pins 52 shown in FIG. 10. The straight aspect of the pins 672 allows the female connector elements 654 to be oriented perpendicularly to the plane established by the pcb 14.

Figure 12:
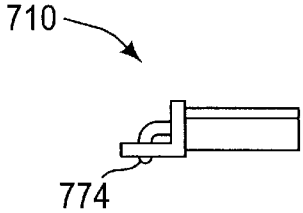
FIG. 12 is a side elevational view of a female combination connector having right-angle surface mount contacts for connecting it to a printed circuit board.

A female combination connector 710 may also comprise a right-angle surface-mounting means, as illustrated in FIG. 12, in which surface mount contacts 774 are provided for connection to a pcb. In this embodiment, the surface mount contacts 774 may be soldered to contact pads on a pcb without the need for through-holes drilled in the pcb.

The pcb mounting means of a female combination connector 910 (FIGS. 15 and 16) may alternatively comprise a cable connector allowing indirect connection or mounting to a pcb through one or more cables. A cable connector comprises a plurality of conductive connection points 984 (FIG. 15) electrically connected to sockets (e.g., 956) in the female connector elements 954, and a locking plate 982 which attaches to a base 950. One or more cables 986 may be attached to the female connector elements 954 of the female combination connector 910. For example, the cables 986 may comprise individual wires (e.g., 990 and 998) or ribbon cables (e.g., 992, 994, and 996).

Figure 16:
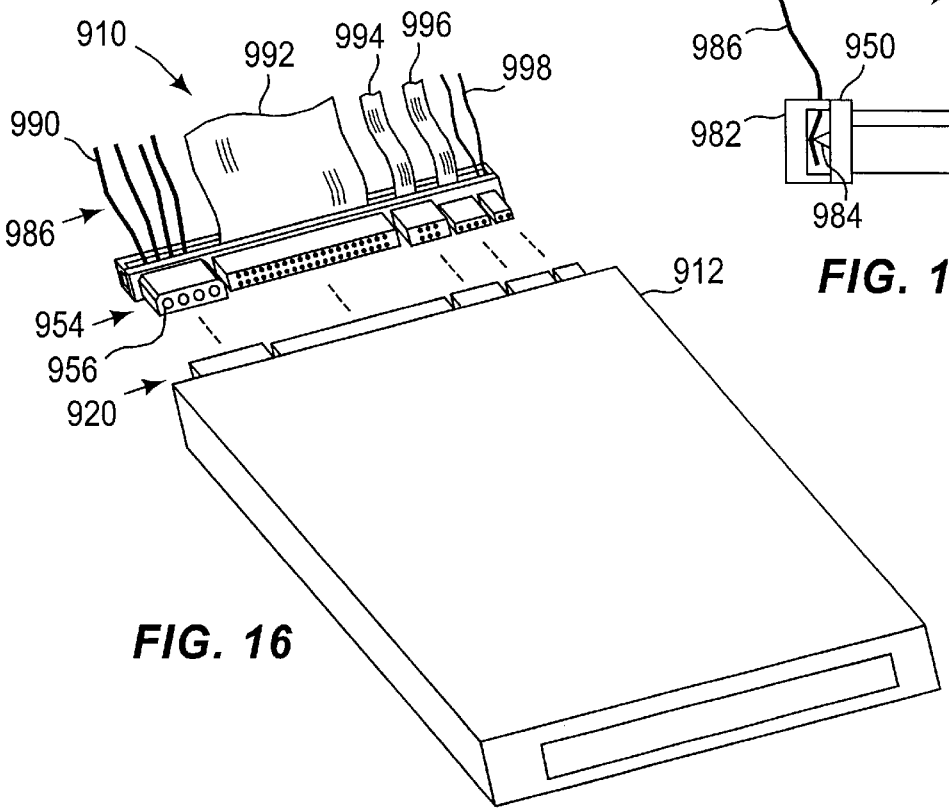
FIG. 16 is a perspective view of the FIG. 15 five element IDE female combination connector, the connector being connected between a plurality of cables and a computer storage drive.

As cables 986 are pressed against the connection points 984, the insulation of the cables 986 is pierced and the sockets (e.g., 956) are electrically connected to the conductors of the cables 986. The locking plate is attached over the cables 986 and the connection points 984 to the base 950 to hold the cables 986 in place against the connection points 984. The locking plate 982 may also be used to press the cables 986 against the connection points 984 after the cables 986 have been aligned adjacent the corresponding connection points 984. The locking plate 982 may be attached to the base 950 using an adhesive, with mechanical clips, or in any other manner. The cables 986 may then be connected to a pcb, power supply, or other element. The female connector elements 954 of the female combination connector 910 may then be connected to the male connectors 920 of a computer storage drive 912 as illustrated in FIG. 16.

Exemplary pcb mounting means have been disclosed. However, the female combination connector (e.g., 10 and 110) may be mounted to a pcb with any connection means now known or that may be developed in the future, such as a straddle mount connector or any other suitable connector. Combinations of pcb connection pins and support members, as well as other means for connecting a female combination connector to a pcb (e.g., surface mount contacts and cable connectors), may sometimes be referred to in the claims as "printed circuit board connectors".

Figure 13:
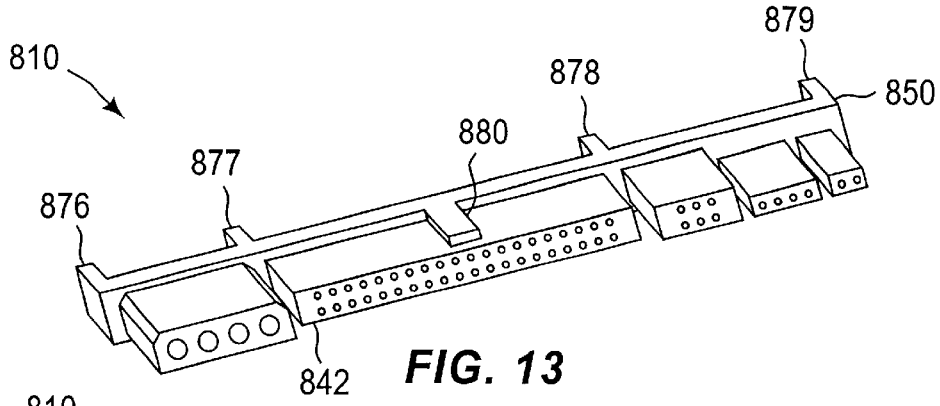
FIG. 13 is a perspective view of a five element IDE female combination connector comprising structural ribs and an alignment tab.
Figure 14:
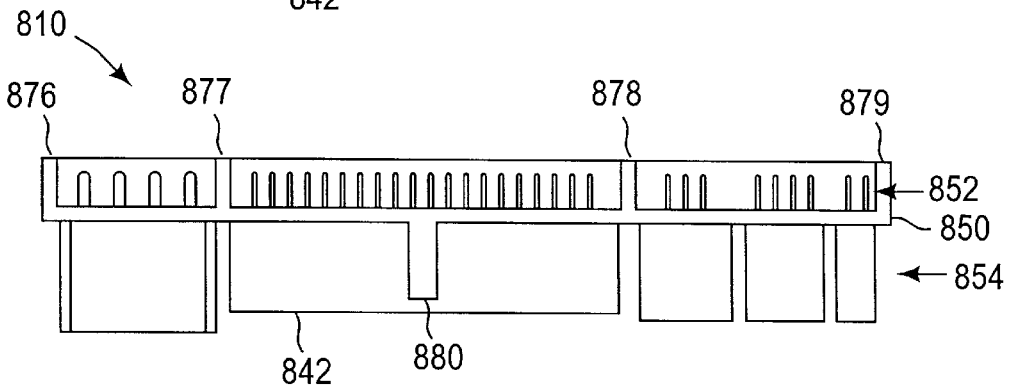
FIG. 14 is a top plan view of the FIG. 13 five element IDE female combination connector.

Referring now to FIGS. 13 and 14, a female combination connector 810 may comprise alignment ridges (e.g., 880) such as those provided for standard individual female connectors, although the unique and distinctive layout of the female connector elements 854 reduce the need for alignment ridges.

A female combination connector 810 may also comprise stiffening ribs 876–879 attached to or molded integrally with the base 850. The locations of the stiffening ribs 876–879 are chosen to provide desired rigidity in the female combination connector 810 while avoiding interference with the pins 852.

While illustrative and presently preferred embodiments of the invention have been described in detail herein, it is to be understood that the inventive concepts may be otherwise variously embodied and employed, and that the appended claims are intended to be construed to include such variations, except as limited by the prior art.

What is claimed is:

1. A female combination connector, comprising:

a base;

a female data connector integrally formed with said base;

a female power connector integrally formed with said base;

a plurality of electrical sockets located in said female data connector and said female power connector, each of said plurality of electrical sockets being adapted to receive a male electrical pin; and a plurality of conductors, each of said plurality of conductors being supported by said base, and each of said plurality of conductors being electrically coupled to one of said plurality of electrical sockets.

2. The connector of claim 1, further comprising a female digital audio connector integrally formed with said base.

3. The connector of claim 1, further comprising a female analog audio connector integrally formed with said base.

4. The connector of claim 1, wherein said female data connector comprises an Integrated Device Electronics data connector.

5. The connector of claim 1, wherein said female data connector comprises a Small Computer System Interface data connector.

6. The connector of claim 1, wherein the plurality of conductors comprises a plurality of straight through-hole pins.

7. The connector of claim 1, wherein the plurality of conductors comprise a plurality of conductive connection points for connecting to conductors of at least one ribbon cable.

8. The connector of claim 1, further comprising a female select connector integrally formed with said base.

9. The connector of claim 8, wherein said female select connector comprises an Integrated Device Electronics master/slave cable select connector.

10. The connector of claim 8, wherein said female select connector comprises a Small Computer System Interface identification select connector.

11. The connector of claim 1, wherein the plurality of conductors comprises a plurality of right-angle through-hole pins.

12. The connector of claim 11, further comprising a support member, said support member being affixed to said base and forming a right angle with said base, and said support member providing additional support for the plurality of conductors.

13. The connector of claim 1, wherein the plurality of conductors comprise a plurality of surface mount contacts.

14. The connector of claim 13, further comprising a support member, said support member being affixed to said base and forming a right angle with said base, and said support member providing additional support for the plurality of conductors.

15. A method for connecting a computer storage drive to a printed circuit board, comprising:

integrally molding a female combination connector comprising:

a base;

a plurality of female connector elements integrally molded with said base; and a plurality of conductors, each of said plurality of conductors being supported by said base, and each of said plurality of conductors being electrically coupled to one of said plurality of female connector elements;

mounting said female combination connector to said printed circuit board by electrically coupling the plurality of conductors of said printed circuit board connector to said printed circuit board; and in a single connection operation, connecting male connector elements of said computer storage drive to the female connector elements of said female combination connector.

16. The method of claim 15, wherein said female connector elements comprise a data connector and a power connector.

17. A female combination connector, comprising:

a base;

first means, integrally formed with said base, for connecting the female combination connector to a plurality of male connectors;

second means, supported by said base, for connecting the female combination connector to a printed circuit board so as to provide an electrical connection between the printed circuit board and said first means; and third means, supported by said base, for connecting the female combination connector to a power supply so as to provide an electrical connection between the power supply and said first means.

18. The connector of claim 17, wherein the second means comprises a plurality of conductive connection points for connecting the female combination connector to a printed circuit board via conductors of at least one ribbon cable.

19. A computer storage assembly, comprising:

a storage device having a plurality of male connectors including a male data connector and a male power connector; and a female combination connector comprising:

a base;

a female data connector integrally formed with said base;

a female power connector integrally formed with said base;

a plurality of electrical sockets located in said female data connector and said female power connector, each of said plurality of electrical sockets being adapted to receive a male electrical pin; and a plurality of conductors, each of said plurality of conductors being supported by said base, and each of said plurality of conductors being electrically coupled to one of said plurality of electrical sockets, wherein said female combination connector is connected to said storage device by having said female data connector connected to said male data connector and said female power connector connected to said male power connector.

* * * * *